United States Patent [19]

Ebmeyer et al.

[11] Patent Number: 4,741,525

[45] Date of Patent: May 3, 1988

[54] APPARATUS FOR CONVEYING FLAT ARTICLES PROVIDED WITH TWO LOCATING HOLES PREFERABLY BAGS MADE OF PLASTIC FILM

[75] Inventors: Wilfried Ebmeyer, Enger; Werner Krutemeier, Löhne, both of Fed. Rep. of Germany

[73] Assignee: Windmoller & Hölscher, Lengerich, Fed. Rep. of Germany

[21] Appl. No.: 799,645

[22] Filed: Nov. 19, 1985

[30] Foreign Application Priority Data

Nov. 19, 1984 [DE] Fed. Rep. of Germany ..... 3442263
Feb. 14, 1985 [DE] Fed. Rep. of Germany ..... 3505109

[51] Int. Cl.[4] ..... B65H 31/04

[52] U.S. Cl. ..... 271/213; 198/627; 198/803.11

[58] Field of Search ..... 271/213, 214; 198/803.11, 817, 627, 586; 474/78

[56] References Cited

U.S. PATENT DOCUMENTS

| | | | |
|---|---|---|---|
| 2,639,025 | 5/1953 | Schmitt | 198/803.11 X |
| 3,779,364 | 12/1973 | Kammann | 198/803.11 X |
| 4,252,233 | 2/1981 | Joice | 198/692 |
| 4,588,779 | 12/1985 | Schmitt et al. | 198/627 |

*Primary Examiner*—George E. A. Halvosa
*Assistant Examiner*—Matthew C. Graham
*Attorney, Agent, or Firm*—Fleit, Jacobson, Cohn & Price

[57] ABSTRACT

Apparatus for conveying stacked flat articles provided with two locating holes each, preferably bags made of plastic, including a stacking conveyor having a pair of juxtaposed endless belts, which are trained around pulleys that are intermittently driven. The conveyor is provided with pairs of upstanding stacking pins, which are secured to respective carrying plates and spaced a variable distance apart. Alternate carrying plates carrying respective stacking pins are connected to respective ones of the belts. The belts are adapted to be moved forwardly and rearwardly relative to each other and to be interconnected by the pulleys in a predetermined relative position. The pulleys are angularly shiftable relative to each other to vary the spacing between the stacking pins.

6 Claims, 3 Drawing Sheets

APPARATUS FOR CONVEYING FLAT ARTICLES PROVIDED WITH TWO LOCATING HOLES PREFERABLY BAGS MADE OF PLASTIC FILM

BACKGROUND OF THE INVENTION

1. Field of the Invention

This invention relates to conveying apparatus, and more particularly to conveying apparatus for conveying flat articles having two locating holes each, the apparatus including spaced pairs of upstanding stacking pins to receive and convey a plurality of groups of the flat articles.

2. Desscription of the Prior Art

Apparatus for making flat bags of paper or plastic film usually includes a so-called wicketer feeder, which is downstream of a bag forming station and upstream of a bag conveyor. The bag forming station includes a transverse welding apparatus for severing plastic bags or the like from a tubular or semitubular plastic film web and for welding panel of the bags. Each of the plastic bags is provided with two spaced locating hole along and adjacent to an edge of the bag, and the bags are received from the bag forming station and are deposited on the radial arms of the rotatable wicketer, which carries the bags through about 180 degrees of wicketer rotation to transfer the bags from the bag forming station to a conveyor that include stacking pins that are spaced to receive the bags. The wicketer transfers the bags so that the stacking pins extend through the locating holes in the bags. Each adjacent pair of stacking pins receives a number of bag to define a stack. When a stack of a predetermined number of bags has been formed, the conveyor is incrementally advanced to move another pair of stacking pins to a stacking position to receive bags from the wicketer.

It is often desired to stack and convey bags which differ in size, or in which the locating holes have different spacings, and therefore adjustability of the spacing of the pairs of stacking pins is desirable. Bag conveying apparatus that permits adjustment of stacking pin spacing is disclosed in U.S. Pat. No. 4,252,233, and includes a pair of adjacent, parallel endless chains having links that are connected to carrying plates which each carry stacking pin. The position of each conveying plate is adjustable along the chains and is provided on its underside with a base plate having a side face that protrudes from a carrying plate. The base plate is provided on its top with two pins, which are guided in a longitudinal groove of a clamping rail. The clamping rail bears on the base plate and is adapted to be forced against the carrying plate by means of screws. When the clamping rail has been released, the stacking pins of each pair can be adjusted to the desired spacing. For this purpose, adjusting arms are pivotally mounted laterally of and above the stacking conveyor and adapted to receive at their free ends the tips of the stacking pins and are pivotally movable to adjust the stacking pins. When the stacking pins have been adjusted to the desired spacing, the clamping rails can be tightened. However, the adjustement of the pairs of stacking pins is a complicated and time-consuming operation because the stacking pins of each pair must be released, adjusted to the desire spacing by means of the adjusting arms, and then secure in position before the stacking pins of the next pair can be moved to a position adjacent to the adjusting arms.

It is an object of the present invention to provide conveying apparatus having stacking pins and in which the spacing of the stacking pins of each pair can be adjusted more easily and more quickly to accommodate bags of a different size, or bags having different locating hole spacings.

SUMMARY OF THE INVENTION

Briefly stated, in accordance with one aspect of the present invention, apparatus is provided for receiving flat articles having a pair of spaced locating holes adjacent one end of the articles and for carrying stacks of the articles. The apparatus includes a frame, a stacking conveyor carried on the frame and including two juxtaposed parallel belts defining endless belt means, the belt means carried on and trained around respective pairs of belt carrying means rotatably supported by the frame. The belt means each carry one of a pair of upstanding spaced stacking pins, the stacking pins are mounted on respective carrying plates with alternate plates carried by respective ones of the belt means. The belts are movable forwardly and rearwardly relative to each other in a conveying direction and are interconnected in a predetermined relative position to define the spacing between stacking pins of a pair. Adjusting means are provided for moving the belts relative to each other in the conveying direction in order to change the spacing between adjacent stacking pins.

DESCRIPTION OF A PREFERRED EMBODIMENT

An illustrative embodiment of the invention will now be explained in more detail with reference to the drawings.

Figure 1:
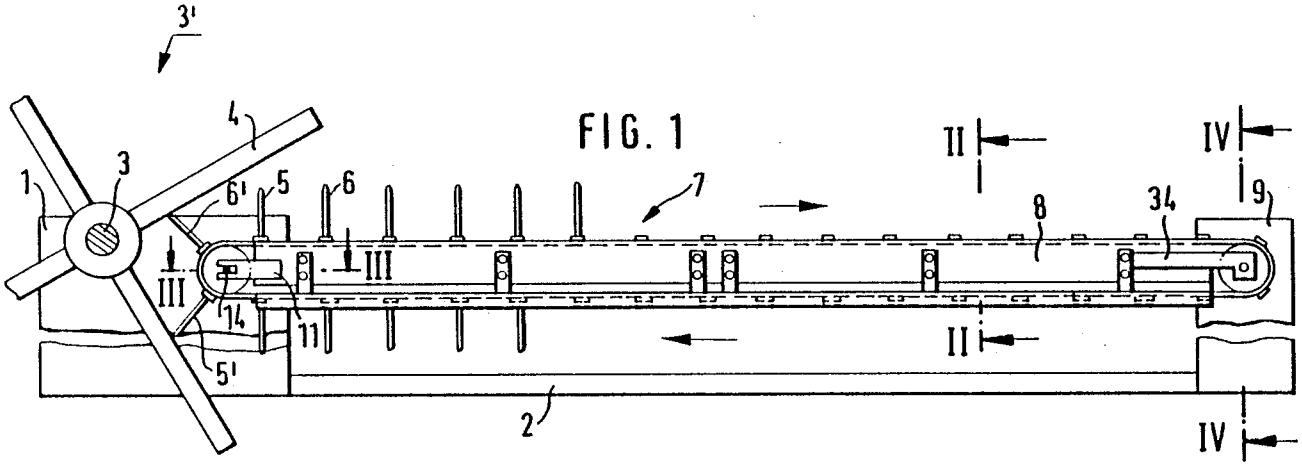
FIG. 1 is a fragmentary side elevational view of a stacking conveyor in accordance with the present invention.

Referring now to FIG. 1, a machine frame 2 includes two laterally spaced forward side panels 1, only one of which is visible in FIG. 1. A shaft 3 of a wicketer 3' is rotatably carried by the side panels 1 and is connected to a suitable drive means (not shown) to cause the shaft to rotate in a clockwise direction as viewed in FIG. 1. Wicketer 3' transfers the plastic bags or other articles from a forming station (not shown) to the left of wicketer 3' as viewed in FIG. 1, to a stacking conveyor 7. Wicketer 3' includes radially extending arms 4, which are carried in axially spaced pairs (only one arm of each pair being visible in FIG. 1) by shaft 3 and are provided with suction cups or other holding means for holding the bags during the transfer operation. The bags, which have been severed from a tubular or semitubular plastic film web and provided with transverse seam welds by a transverse welder (not shown), are received on and carried by respective pairs of arms 4. One end of each bag extends laterally beyond one arm of each pair and is formed with two locating holes. The bag is carried by the pair of arms through part of an arc of rotation of the wicketer, approximately 180°, and is deposited by means of the arms 4 onto the stacking conveyor 7 so that the locating holes of the bag pass over and around the spaced pairs of stacking pins 5, 6, which receive successive bags until a stack of a predetermined number of plastic bags has been formed. When a desired stack of bags has been accumulated on a pair of stacking pins 5, 6, the stacking conveyor is incrementally advanced until the next pair of stacking pins 5', 6' is in stacking position to receive bags to form a second stack of bags.

Figure 3:
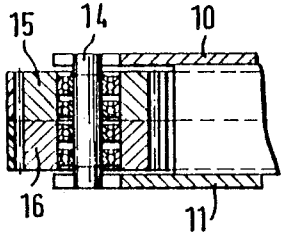
FIG. 3 is a fragmentary cross-sectional view taken along the line III—III of FIG. 1 adjacent the receiving end of the stacking conveyor.

The stacking conveyor 7 includes a longitudinally extending support girder 8, which is carried between and supported by the forward side panels 1 and by rear side panels 9. The respective side panels 1, 9 are spaced from each other along machine frame 2. At the upstream or receiving end of the stacking conveyor 7, adjacent wicketer 3', an axle 14 is mounted in bearing brackets 10, 11 (see FIGS. 1 and 3), the latter of which are secured to opposite sides of support girder 8. Two closely spaced gears 15, 16 are freely rotatably mounted on the axle 14 by means of rolling element bearings.

At the downstream end of the stacking conveyor 7 (see FIG. 4), a shaft 17 is freely rotatably mounted by means of rolling element bearings in rear side panels 9 supported by machine frame 2. A first gear 18 having an axial extension in the form of a hub 19 is keyed to the shaft 17 to rotate therewith. A second gear 20 is rotatably carried on hub 19 adjacent to gear 18 and includes two arcuate slots 21 (see FIG. 5), which have a center-to-center spacing of 180° and which extend for a predetermined length of a circular arc that is concentric to the axis of shaft 17. Headed clamping bolts 22 extend through each of slots 21 and are in threaded engagement with tapped bores 23 in first gear 18. Adjacent hub 19, first gear 18 is formed with an annular collar 24, having a substantially cylindrical outer surface which defines a shoulder that includes tapped bores 23.

Second gear 20 is formed with an axially protruding outer flange 25, which overlies and is radially spaced from collar 24. Flange 25 is formed with internal gear teeth 27, which are spaced radially outwardly of collar 24 and define an annular space therewith. A pinion 28 is rotatably positioned within the annular space between collar 24 and flanqe 25 and is in mesh with internal gear teeth 27. Pinion 28 is secured to one end of a shaft 29 that is rotatably carried in an axially extending bore 30 in first gear 18. Bore 30 is spaced between the axis and the outer periphery of first gear 18 to permit pinion 28 to mesh with internal gear 27. On the opposite end of shaft 24 from pinion 28, and on the opposite side of gear 18 from second gear 20, a drive member 31 is formed and can have a square or otherwise shaped end for engagement by a drive means, such as a wrench or the like. Preferably, shaft 29 is rotatably mounted in first gear 18 with adequate friction therebetween so that an undesired spontaneous movement will be prevented.

Figure 2:
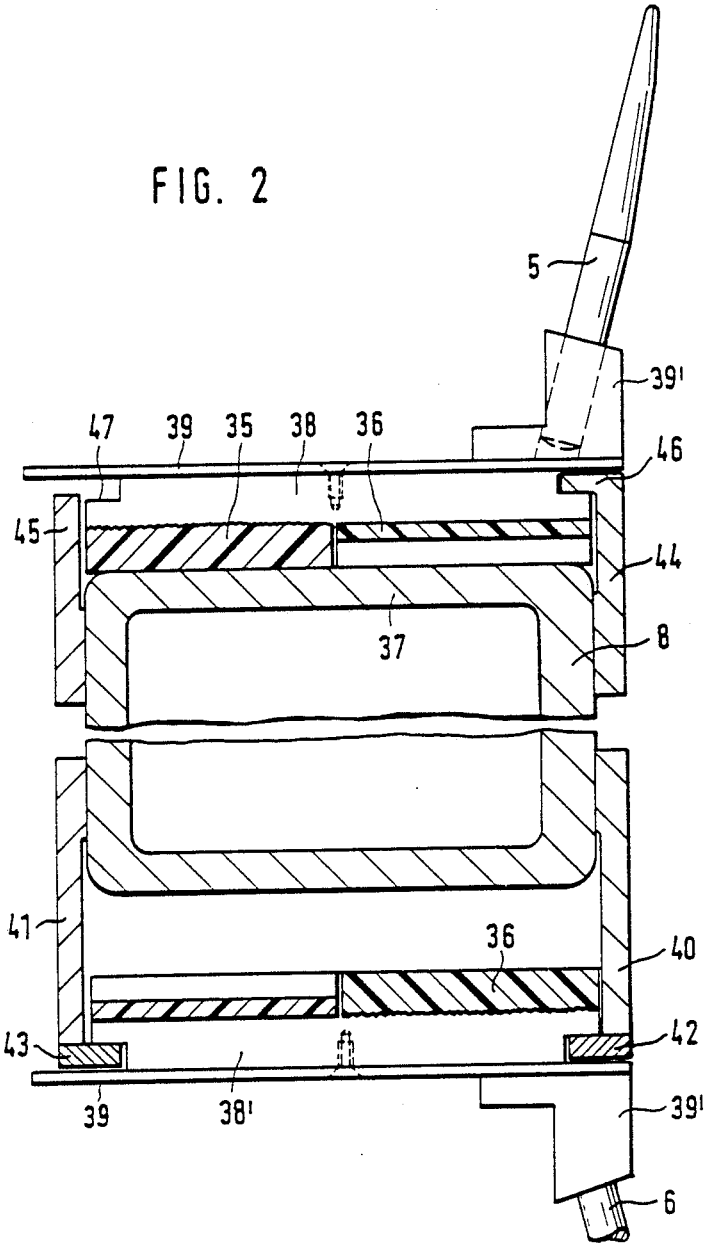
FIG. 2 is a fragmentary cross-sectional view taken along the line II—II of FIG. 1 and shows a portion of the stacking conveyor on an enlarged scale.

Two parallel belts 35, 36 engage with the outer periphery of gears 15, 16 and 18, 20 respectively, and include spaced, transversely extending teeth that engage with the gears by extending into the spaces between the teeth on the respective gears. The belt teeth prevent belt slippage relative to the respective gears. As best seen in FIG. 2, the girder 8 includes an upwardly facing surface 37, which is in sliding contact with the teeth of the upper course of each belt 35, 36, and which preferably is polished to reduce friction and wear of the belts. A plurality of individual carrying plates 38 are aligned in the direction of movement of belts 35, 36, and alternate plates 38 are adhesively joined to respective ones of the belts 35, 36. For example, the carrying plate 38 shown on the upper surface 37 of support girder 8 in FIG. 2 is adhesively joined to the left-hand belt 35, and the next preceding and next following carrying plates are adhesively joined to the right-hand belt 36. Each plate 38 extends over each belt 35, 36, but is secured to only one of the belts. Below support girder 8 in FIG. 2 is another carryiny plate 38', which as shown is adhesively joined to the lower course of the right-hand belt 36. Respective individual cover plates 39 are connected by screws to each of the carrying plates 38,38'. Stacking pins 5, 6 are connected to respective adjacent cover plates 39 by means of stacking pin holders 39' secured to one outer end of each plate 39. As shown, stacking pins 5, 6 extend upwardly from the outermost surfaces of each of plates 39 and are inclined outwardly relative to plates 39 as can be seen on the right side of FIG. 2.

Figure 4:
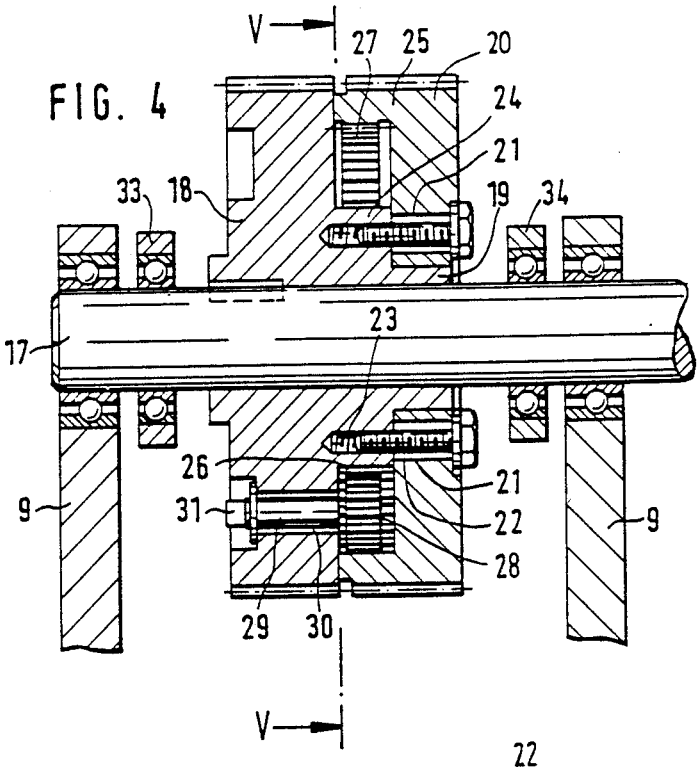
FIG. 4 is a fragmentary cross-sectional view taken along the line IV—IV of FIG. 1 adjacent the delivery end of the stacking conveyor.
Figure 5:
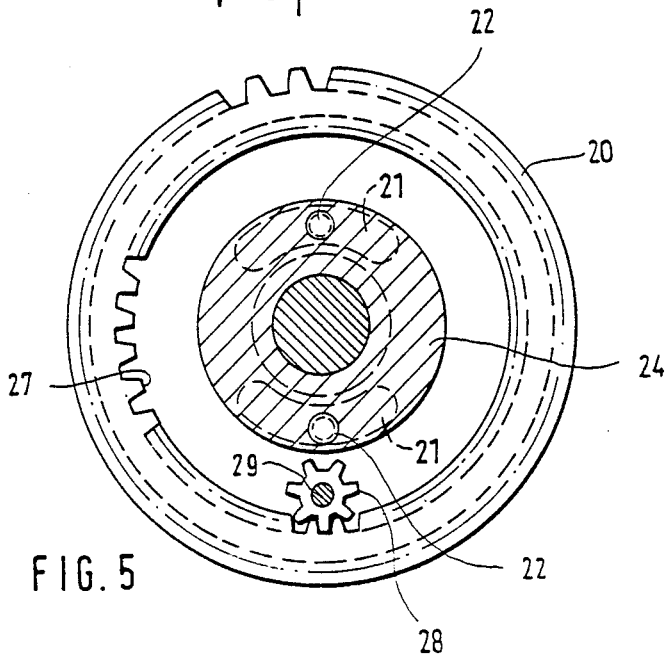
FIG. 5 is a cross-sectional view taken along the line V—V of FIG. 4 and showing a pair of conveyor drive gears at the delivery end of the stacking conveyor.

As shown in FIGS. 1 and 4, girder 8 is supported from shaft 17 by brackets 33, 34, which are provided on girder 8 adjacent the downstream end of conveyor 7, and are mounted on the shaft 17 by means of rolling element bearings. The shaft 17 is operatively connected to a suitable intermittent drive (not shown) and is intermittently operable to advance the belts 35, 36 in predetermined increments corresponding to a stack pitch.

The carrying plates 38 have only a small width in the direction of conveyance so that they can easily move around the gears 15, 16 and 18, 20. As shown in FIG. 2, carrying plates 38 are formed at their outer edges with steps 47, which interfit with and receive inwardly extending guide bars 42, 43, which are connected to lateral guide plates 40, 41 carried by and depending from girder 8. Guide plates 40, 41 are adjacent to the lower course of each belt 35 or 36, and fluid bars 42, 43 extend inwardly from the respective gide plates 40, 41. Guide bars 42, 43 serve to supprt the lower course of each belt 35 or 36 by engaging with steps 47 in plates 38. The upper course of each belt 35, 36 is laterally guided by means of upwardly extending guide plates 44, 45, which are connected to the girder 8. Guide plate 44 includes an inwardly directed flange 46, which overlies steps 47 on the side of carrying plates 38 adjacnet stacking pins 5, 6, so as to prevent a canting or tilting of the carrying plates 38 as a result of the load of the overhanging stacks of bars that extend over the opposite ends of plates 38 adjacent guide plate 45. The flanges 46 and the guide bars 42, 43 are overlapped by the cover plates 39.

In operation, when it is desired to adjust the two gears 18, 19 to a predetermined angular position relative to each other, which corresponds to a desired spacing of the stacking pins 5, 6 of each respective pair of pins, the bolts 22 are loosened and the pinion 28 is rotated by means of a wrench or the like applied to drive member 31 to turn second gear 20 relative to first gear 18 by means of internal gear teeth 27, to move the respective belts 35, 36, relative to each other to shift each of pins 5, 6 until the desired pin spacing is achieved. After the desired adjustment, the clamping bolts 22 are retightened to prevent relative rotation between gears 18 and 20 and thereby maintain the desired pin spacing. As a result, a single adjusting operation is sufficient to adjust all the stacking pins to the desired spacing, so that the apparatus can be adapted to bars of a different size or of a different hole spacing in a single fast and simple operation.

Although particular embodiments of the present invention have been illustrated and described, it will be apparent to those skilled in the art that changes and modifications can be made without departing from the spirit of the present invention. It is intended to cover in the appended claims all such changes and modifications that fall within the scope of the present invention.

What is claimed is:

1. Apparatus for receiving flat articles having a pair of spaced locating holes adjacent one end of the articles and for carrying stacks of the articles, which apparatus comprises: a frame; a stacking conveyor carried on said frame and including two juxtaposed parallel belts defining endlessly belt means, said belt means carried on and trained around respective pairs of belt carrying means rotatably supported by said frame, said belt means each carrying one of a pair of upstanding spaced stacking pins, said stacking pins mounted on respective carrying plates with alternate plates carried by respective ones of said belt means, said belt means being movable forwardly and rearwardly relative to each other in a conveying direction and interconnected in a predetermined relative position to define the spacing between stacking pins of a pair, and adjusting means for moving said belt means relative to each other in said conveying direction to change the spacing between adjacent stacking pins, wherein said belt carrying means includes a pair of gears at each end of said stacking conveyor, said belt means each trained around one of a pair of gears disposed at respective ends of the stacking conveyor, the gears of one pair mounted on a common shaft and feely rotatable relative to each other, and the gears of the other pair interconnected in a predetermined angular position relative to each other and including means to adjust the relative angular position therebetween, wherein the pair of relatively angularly adjustable gears includes a first gear having an axially extending hub, and a second gear rotatably mounted on said hub and formed with at least one arcuate slot concentric to a common axis of the two gears, a clamp bolt extending through aid slot and in threaded engagement with said tapped bore formed in the adjacent side face of the first gear to permit relative angular movement between the said first and second gears when said clamp bolt is loosened and to secure said gears in a predetermined relative angular position when said clamp bolt is tightened, said first gear including an annular collar adjacent to its hub to define a shoulder, said second gear includes an axially extending flange spaced radially from and overlying said shoulder to define an annular space therebetween, said collar having a substantially cylindrical outer surface, and said flange having internal gear teeth, a pinion in said annular space in meshing engagament with said internal gear teeth and connected to a shaft which extends through an axial bore of said first gear, said shaft having a drive member at its end opposite to said pinion and disposed on the outside of the first gear for engagement by a drive means.

2. Apparatus according to claim 1, wherein the freely rotatable gears are juxtaposed and rotatably mounted on an axle which is fixed to said frame.

3. Apparatus according to claim 1, wherein the gears which are angularly adjustable relative to each other are provided at a delivery end of the stacking conveyor.

4. Apparatus according to claim 1, wherein an upper course of each belt means is in sliding contact with a backing surface, said backing surface including a pair of laterally spaced guides protruding above the backing surface for guiding said belt means.

5. Apparatus according to claim 1, wherein said frame includes a girder extending between said belt carrying means, and said girder includes guide bars in sliding contact with said carrying plates for supporting and laterally guiding a lower course of said belt means.

6. In a conveying system for articles engaged at points spaced in the direction of movement of the articles to retain the articles in predetermined relation during movement, said conveying system including a pair of side-by-side conveying elements, means driving said conveying elements including a drive member, means drivingly interconnecting the drive member and both conveying elements and means on each conveying element engaging an article at spaced points in the direction of movement of the article, the improvement of said means interconnecting the drive member and conveying elements comprising releasable securing means selectively drivingly connecting the drive member to at least one of said conveying elements to enable relative movement of the conveying elements and article engaging means thereon for engaging articles having different physical characteristics, said means interconnecting the drive member and conveying elements also including means operable independently of the releasable securing means to move at least one of the conveying elements in relation to the other to adjust the spacing between the article engaging means when the releasable securing means is released, each of said conveying elements being an endless flexible member entrained around rotatable end members, said drive member including a drive shaft with one of the end rotatable members fixed thereto for driving one of the flexible members, said releasable securing means interconnecting the drive shaft and the other rotatable end member with rotation of the drive shaft providing positive drive to one of the flexible members and selective drive to the other flexible member through the releasable securing means, said means for moving at least one of the conveying elements comprising arcuate movement imparting means interconnecting the two rotatable end members to move one of the rotatable end members in angular relation to the other and to the drive shaft when the releasable securing means is released thereby moving one of the flexible members in relation to the other, said arcuate movement imparting means comprising an internal gear mounted on one of said rotatable end members and a pinion gear rotatably journaled on the other rotatable end member with the pinion gear in meshing engagement with the internal gear, said pinion gear including means receiving a power input member by which the pinion gear can be rotated thereby rotating the internal gear in opposite direction for moving the rotatable end members in angular relation to each other and moving the flexible members and articel engaging means thereon in relation to each other in the direction of movement of the articles.

* * * * *